US010619395B2

(12) United States Patent
Kim et al.

(10) Patent No.: US 10,619,395 B2
(45) **Date of Patent: *Apr. 14, 2020**

(54) REFRIGERATOR

(71) Applicant: LG Electronics Inc., Seoul (KR)

(72) Inventors: Hyunbum Kim, Seoul (KR); Dongjeong Kim, Seoul (KR); Sunghun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/272,464

(22) Filed: Feb. 11, 2019

(65) Prior Publication Data

US 2019/0169911 A1 Jun. 6, 2019

Related U.S. Application Data

(63) Continuation of application No. 15/813,883, filed on Nov. 15, 2017, now Pat. No. 10,202,792.

(30) Foreign Application Priority Data

Apr. 5, 2017 (KR) ..... 10-2017-0044349

(51) Int. Cl.
*E05F 15/619* (2015.01)
*F25D 23/02* (2006.01)

(52) U.S. Cl.
CPC ..... *E05F 15/619* (2015.01); *F25D 23/028* (2013.01); *E05Y 2201/426* (2013.01); *E05Y 2900/31* (2013.01); *F25D 2323/02* (2013.01)

(58) Field of Classification Search
CPC .... F25D 23/028; F25D 23/02; F25D 2323/02; E05F 15/619
See application file for complete search history.

(56) References Cited

U.S. PATENT DOCUMENTS

| | | | | |
|---|---|---|---|---|
| 9,631,857 | B2 * | 4/2017 | Yoon | E06B 7/18 |
| 9,909,800 | B2 * | 3/2018 | Jung | F25D 23/02 |
| 10,202,792 | B2 * | 2/2019 | Kim | F25D 23/028 |
| 2010/0141107 | A1 * | 6/2010 | Kim | F25D 23/028 312/405 |
| 2011/0048060 | A1 * | 3/2011 | Kim | E05B 17/0029 62/449 |
| 2011/0083461 | A1 * | 4/2011 | Kim | F25D 23/028 62/264 |
| 2016/0245579 | A1 * | 8/2016 | Eom | E05D 7/00 |
| 2016/0312516 | A1 * | 10/2016 | Heydel | H02K 7/116 |
| 2017/0261252 | A1 * | 9/2017 | Son | F25D 23/028 |

(Continued)

FOREIGN PATENT DOCUMENTS

WO 2016-175562 11/2016

*Primary Examiner* — Daniel J Rohrhoff
(74) *Attorney, Agent, or Firm* — Fish & Richardson P.C.

(57) ABSTRACT

A refrigerator includes a cabinet defining a storage compartment, a door configured to open and close the storage compartment, and a door opening device configured to open the door. The door opening device includes a driving unit and a pushing member configured to be pushed out by the driving unit to thereby open the door. The pushing member includes a first rack configured to be driven by the driving unit in a first direction, and a second rack configured to be driven by the driving unit in the first direction. The first rack is slidably coupled to the second rack to thereby move relative to the second rack.

20 Claims, 19 Drawing Sheets

(56) References Cited

U.S. PATENT DOCUMENTS

| | | | | |
|---|---|---|---|---|
| 2017/0266794 | A1* | 9/2017 | Hettich | B25B 27/143 |
| 2017/0321952 | A1 | 11/2017 | Jung et al. | |
| 2017/0336132 | A1* | 11/2017 | Chang | F25D 23/028 |
| 2018/0038634 | A1* | 2/2018 | Kim | F25D 29/00 |

* cited by examiner

REFRIGERATOR

CROSS-REFERENCE TO RELATED APPLICATIONS

This application is a continuation of U.S. application Ser. No. 15/813,883, filed on Nov. 15, 2017, now allowed, which claims priority under 35 U.S.C. § 119 to Korean Patent Application No. 10-2017-0044349, filed in Korea on Apr. 5, 2017. The disclosures of the prior applications are incorporated by reference in their entirety.

FIELD

The present disclosure relates to a refrigerator.

BACKGROUND

A refrigerator is a home appliance that can keep objects such as food in a storage compartment provided in a cabinet at a low temperature. The storage compartment may be surrounded by an insulation wall such that the internal temperature of the storage compartment is maintained at a temperature lower than an external temperature.

The storage compartment may be referred to as a refrigerating compartment or a freezing compartment according to the temperature range of the storage compartment.

A user may open and close the storage compartment using a door. The user opens the door in order to put objects into the storage compartment or take objects out of the storage compartment. In some examples, the door is rotatably provided on the cabinet and a gasket is provided between the door and the cabinet.

In some cases, in a state of closing the door, the gasket is closely adhered between the door and the cabinet to prevent leakage of cool air from the storage compartment. As adhesion force of the gasket increases, the effect of preventing leakage of cool air may increase.

In order to increase adhesion force of the gasket, the gasket may be formed of, for example, a rubber magnet or a magnet may be provided in the gasket. However, if adhesion force of the gasket increases, a large force may be required to open the door.

Recently, refrigerators having an auto closing function have been provided. For example, an auto closing function refers to a function for automatically closing the door of the refrigerator using adhesion force and magnetic force of the gasket and elastic force of a spring when the door of the refrigerator is slightly opened.

In some examples, the auto closing function refers to a function for preventing the door of the refrigerator from being automatically opened even when the refrigerator is slightly tilted forward.

In some cases, the refrigerators may require a large force to open a door because a user may pull the door with force larger than adhesion force and magnetic force of a gasket and elastic force of a spring.

Recently, a door opening device for automatically opening a door has been proposed.

In some examples, the refrigerator may include a door and a door opening device mounted in the door.

The door opening device may be provided in a cap decoration part of the door of the refrigerating compartment. In this case, it may be difficult to increase the front-and-rear length of the door opening device to be greater than the front-and-rear length (thickness) of the door.

The door opening device may include a rack which is withdrawn from and inserted into the door by driving a motor.

Driving power of the motor may be transferred to the rack through a power transferring device. In some cases, the rack is withdrawn when the motor is driven in one direction and the rack is inserted when the motor is driven in the other direction.

In some examples, the power transferring device may include a plurality of gears and rotation power of the motor may be transferred to the rack by rotating the plurality of gears. In some cases, the rack includes a rack body and a rack gear formed in the rack body. Driving power of the motor is transferred to the rack through engagement between the gears and the rack gear.

In other examples, the rack pushes a cabinet in a process of withdrawing the rack, thereby opening the door.

In this case, the door may be automatically opened in a state in which a user does not apply pulling force to the door.

The opening angle of the door may depend on the withdrawal distance of the rack. For example, the rack may have a curved shape and the door may be automatically opened by about 25 degrees.

In some cases, the door is automatically opened for a user to take food out of the storage compartment or to put food into the storage compartment without manually opening the door. Accordingly, the door may be opened to provide a space sufficient for the user to access the storage compartment.

However, when the door is opened by only about 25 degrees, the user may not satisfactorily use the refrigerator.

For example, when the door is automatically opened by about 25 degrees, the user may further open the door using the body or foot thereof while the user may hold objects in both hands. In this case, an unsanitary problem may occur and automatically opening the door may cause an inconvenience for the user.

In some examples, it may be difficult to increase the withdrawal distance of the rack, because the length of the rack is limited by the thickness of the door. For example, there is a limitation in increase in the length of the rack due to restriction in the internal space of the door of the refrigerator. Therefore, there is a limitation in increase in the protrusion length of the rack.

SUMMARY

The present disclosure provides a refrigerator capable of increasing an opening angle of a door using a relatively moving multi-stage rack.

The present disclosure provides a refrigerator capable of minimizing the length of a multi-stage rack in a state of closing a door to overcome space restriction of a multi-stage rack.

The present disclosure provides a refrigerator capable of connecting the racks of a multi-stage rack to each other and moving the racks together.

The present disclosure provides a refrigerator capable of preventing a phenomenon that a door is kept open due to incomplete insertion of a multi-stage rack in a process of inserting the multi-stage rack.

The present disclosure provides a refrigerator capable of preventing abrasion and noise by friction between racks in a process of moving a multi-stage rack.

According to one aspect of the subject matter described in this application, a refrigerator includes a cabinet defining a storage compartment, a door configured to open and close the storage compartment, and a door opening device configured to open the door in which the door opening device includes a driving unit and a pushing member configured to be pushed out by the driving unit to thereby open the door. The pushing member includes a first rack configured to be driven by the driving unit in a first direction, and a second rack configured to be driven by the driving unit in the first direction in which the first rack is slidably coupled to the second rack to thereby move relative to the second rack.

Implementations according to this aspect may include one or more following features. The first rack may be configured to be withdrawn by a predetermined distance relative to the second rack. The first rack may be configured to move together with the second rack based on the first rack being withdrawn by the predetermined distance relative to the second rack. The pushing member may be configured, based on completion of opening the door, to return to an initial position. The first rack may be configured to move together with the second rack toward the initial position in a second direction opposite the first direction, and the first rack may be configured to move relative to the second rack to the initial position in the second direction.

In some implementations, the first rack may be configured to be withdrawn by a predetermined distance relative to the second rack. The door opening device may further include a first transferring member that is configured to couple the first rack to the second rack and to transfer movement power from the first rack to the second rack based on the first rack being withdrawn by the predetermined distance. In some examples, the first transferring member may include a protrusion that is fixed to the first rack and that protrudes from the first rack toward the second rack, the second rack may define a receiving groove configured to receive the protrusion of the first transferring member, and the receiving groove may extend along the second rack by a predetermined length greater than a length of the protrusion along the first rack.

In some implementations, the refrigerator may further include a second transferring member that is movably provided in the second rack and that is configured to transfer movement power from the second rack to the first rack based on the second rack moving in the first direction. The door opening device may further include a power transmission part that includes a connection gear configured to transfer power of the driving unit to the pushing member, the first rack may include a first rack gear configured to engage with the connection gear, and the second rack may include a second rack gear configured to engage with the connection gear.

In some implementations, the first rack gear may be arranged along a longitudinal direction of the first rack, and the second rack gear may be arranged at a rear portion of the second rack along a longitudinal direction of the second rack. The second transferring member may be configured, based on the connection gear being engaged with the second rack gear, to contact the first rack to thereby transfer movement power of the second rack to the first rack. In some cases, the first rack may be located vertically above the second rack, and the second transferring member may be movably provided in the second rack and configured to move in a vertical direction.

In some implementations, the refrigerator may further include a support frame defining a receiving space that receives the pushing member, and the support frame may include a frame guide located in the receiving space. The frame guide may have a first portion extending in a horizontal direction, an inclined guide surface that slopes from the first portion and is configured to lift the second transferring member, and a second portion that extends from the inclined guide surface in the horizontal direction and is located vertically above the first portion. The second transferring member may be configured to slide downward along the inclined surface toward the first portion of the frame guide based on the second rack being driven in a second direction opposite the first direction.

In some implementations, the second transferring member may include an inclined surface configured to contact the inclined guide surface, and the second transferring member may be configured to be lifted to the second portion of the frame guide based on the inclined surface sliding upward along the inclined guide surface. In some examples, the second transferring member may include a pressurization surface configured to contact the first rack based on the second transferring member being lifted by the inclined guide surface. The pressurization surface may be inclined with respect to a top surface of the second transferring member, and wherein the second transferring member may be configured to be lowered by movement power of the first rack based on the first rack pushing the pressurization surface. In some cases, the first rack may include an inclined contact surface configured to contact the pressurization surface.

In some implementations, the refrigerator may further include a guide cover fixed to the second rack and configured to guide vertical movement of the second transferring member. The guide cover may be configured to contact the first rack based on the first rack moving over the second transferring member. In some examples, the refrigerator may further include a rack guide member coupled to the second rack and configured to guide movement of the pushing member, the rack guide member may be configured to guide movement of the first rack based on the first rack moving relative to the second rack, and the rack guide member may be configured to move together with the second rack based on the second rack moving together with the first rack. In some cases, the rack guide member may include a guide rib, and the first rack may include a guide groove that receives the guide rib.

In some implementations, the refrigerator may further include a friction member coupled to the first rack and located between the first rack and the guide rib to thereby prevent direct friction between the first rack and the guide rib in which the friction member may be made of a different material than the first rack and the rack guide member.

In some implementations, the refrigerator may further include a friction member located between the first rack and the second rack to thereby prevent direct contact between the first rack and the second rack in which the friction member being made of a different material than the first rack and the second rack. In some examples, each of the first and second racks may be curved with a predetermined radius about a rotation center of the door. In some cases, when the first rack moves together with the second rack in the first direction, a length of a first portion of the first rack that overlaps with the second rack may be greater than a length of a second portion of the first rack that protrudes from the second rack in the first direction.

DETAILED DESCRIPTION

Hereinafter, example implementations of the present invention will be described in detail with reference to the drawings.

Figure 1:
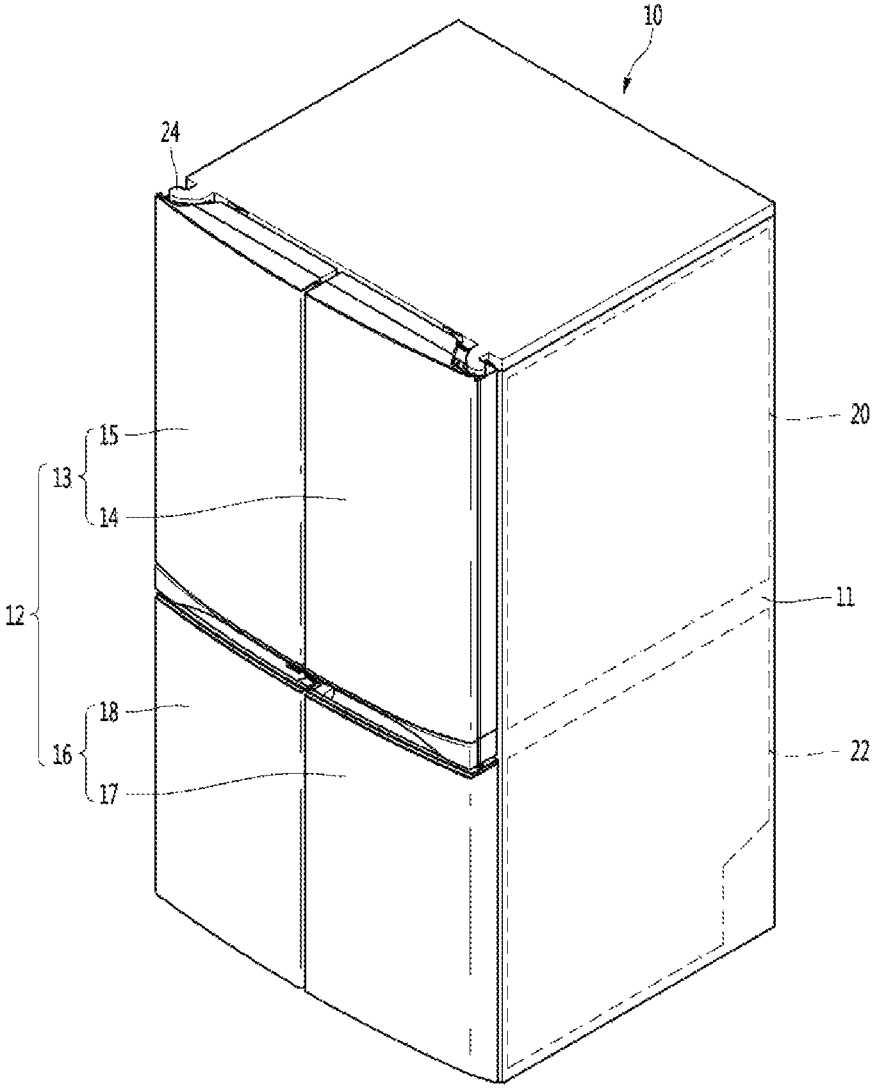
FIG. 1 is a perspective view showing an example refrigerator.
Figure 2:
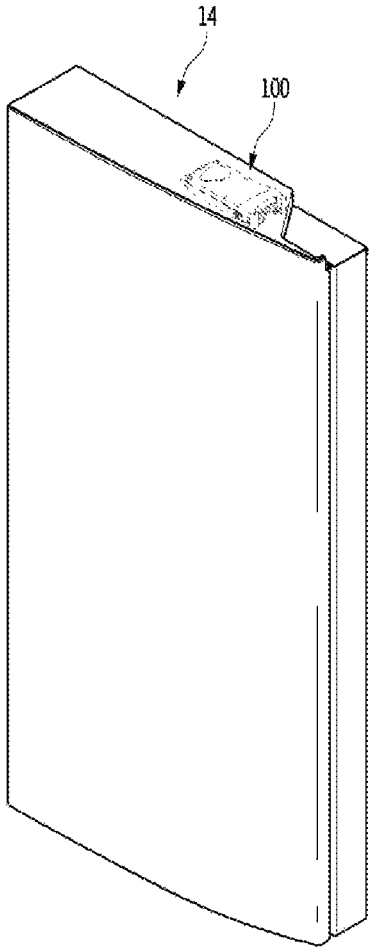
FIG. 2 is a perspective view showing an example door opening device provided in an example door.

FIG. 1 is a perspective view showing an example refrigerator, and FIG. 2 is a perspective view showing an example door opening device provided in an example door.

Referring to FIGS. 1 and 2, the refrigerator 10 may include a cabinet 11 defining a storage compartment and a door 12 for opening and closing the storage compartment.

The storage compartment may include a refrigerating compartment 20 and a freezing compartment 22. The refrigerating compartment 20 may be located above the freezing compartment 22, without being limited thereto. For example, according to the shape of the refrigerator, the freezing compartment 22 and the refrigerating compartment 20 may be provided side by side or the freezing compartment 22 may be located above the refrigerating compartment 20.

The door 12 may include a refrigerating-compartment door 13 for opening and closing the refrigerating compartment 20 and a freezing-compartment door 16 for opening and closing the freezing compartment 22.

The refrigerating-compartment door 13 may include a pair of doors 14 and 15 disposed side by side. The freezing-compartment door 16 may include a pair of doors 17 and 18 disposed side by side.

The door 12 may be rotatably connected to the cabinet 11 by a hinge 24.

In some implementations, the arrangement and numbers of the refrigerating-compartment doors 13 and the freezing-compartment doors 16 are not limited thereto.

The door 12 may include a door opening device 100 for automatically opening the door 12 in a state in which a user does not apply force.

The door opening device 100 may be provided in the door 12 which needs to be automatically opened. FIG. 2 shows the door opening device 100 provided in the refrigerating-compartment door 13.

In some implementations, the door opening device 100 is driven in a predetermined condition or state and the door is automatically opened by driving the door opening device 100. Accordingly, force required for the user to open the door may be reduced or may not be required.

For example, when a sensor recognizes approach of a user, a user presses a specific button, or an open command is input through a touch type input unit, the door opening device 100 may be driven.

Hereinafter, the door opening device 100 will be described in detail.

Figure 3:
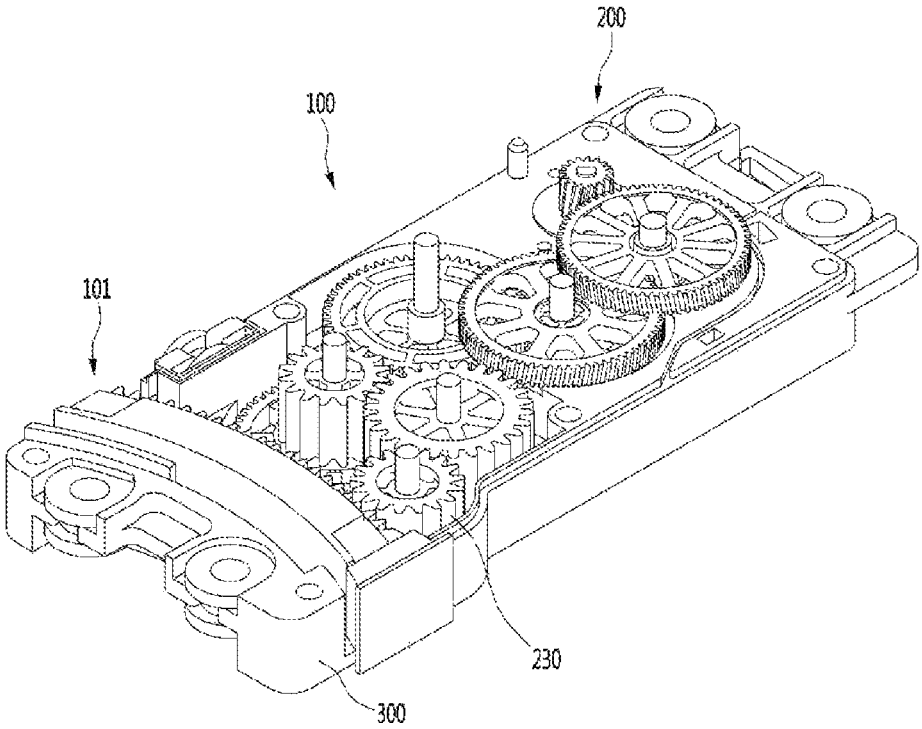
FIG. 3 is a perspective view showing an example door opening device.
Figure 4:
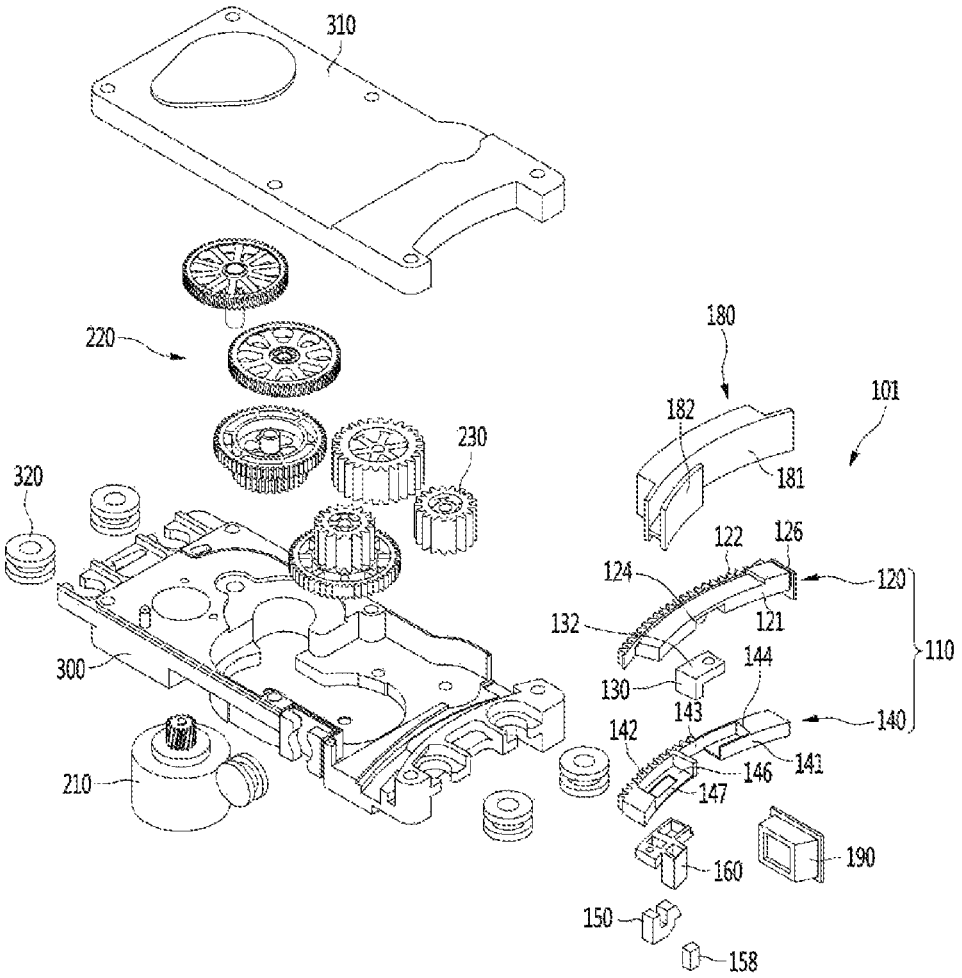
FIG. 4 is an exploded perspective view showing the door opening device of FIG. 3.

FIG. 3 is a perspective view showing an example door opening device, and FIG. 4 is an exploded perspective view showing the door opening device of FIG. 3.

Referring to FIGS. 3 and 4, the door opening device 100 may include a driving unit 200 and a door opening part 101 or a pushing member operated by power received from the driving unit 200.

The door opening part 101 receives driving power of the driving unit 200 and pushes the cabinet 11 while moving, thereby opening the door.

The door opening part 101 may include a multi-stage rack 110 in order to increase the opening angle of the door 12. In some examples, the multi-stage rack 110 may be a pushing member that is configured to push the cabinet or the door.

In some implementations, the driving unit 200 and the multi-stage rack 110 may be provided in support frames 300 and 310.

The support frames 300 and 310 may be provided in the door 12. The support frames 300 and 310 may include a lower frame 300 and an upper frame 310.

The driving unit 200 and the multi-stage rack 110 may be seated in the lower frame 300 and the upper frame 310 may cover the driving unit 200 and the multi-stage rack 110.

One or more buffer members 320 may be coupled to the support frame 300 and 310. The buffer member 320 may be formed of an elastic material such as rubber or silicon, for instance. The buffer member 320 may attenuate vibration generated upon driving the door opening device 100, thereby preventing noise.

The driving unit 200 may include a motor 210 and a power transmission part 220 for transferring power of the motor 210 to the multi-stage rack 110. The power transmission part 220 may include a plurality of gears.

The gears are reduction gears for reducing the rotation speed of the motor 210 to transferring force for driving the multi-stage rack 110 to the multi-stage rack 110.

The plurality of gears may include a connection gear 230 directly connected to the multi-stage rack 110.

The length of the multi-stage rack 110 may be changed by driving power transferred by the connection gear 230.

For example, the multi-stage rack 110 may include a first rack 120 and a second rack 140 moving relative to the first rack 120.

The first rack 120 and the second rack 140 may be provided to overlap each other. The first rack 120 and the second rack 140 may be vertically stacked, without being limited thereto.

When the multi-stage rack 110 is withdrawn from the door 12, an end of the multi-stage rack 110 pushes the cabinet 11 such that the door 12 rotates relative to the cabinet 11.

The length of the multi-stage rack 110 is minimized when the door 12 is closed and is maximized when the door 12 is opened at a predetermined angle. At this time, as the length of the multi-stage rack 110 increases, the opening angle of the door 12 may increase.

In some implementations, since the length of the multi-stage rack 110 is minimized when the door 12 is closed, the multi-stage rack 110 becomes compact and thus space restriction may be reduced in the door 12.

In contrast, since the length of the multi-stage rack 110 is maximized when the door 12 is opened, the opening angle of the door 12 increases.

The multi-stage rack 110 may be withdrawn from the door 12 when the door 12 is opened and may be inserted into the door 12 after opening of the door 12 is finished.

For example, when the door 12 is opened, the first rack 120 may be withdrawn alone from the door 12 by a predetermined distance and then the first rack 120 and the second rack 140 may be withdrawn together.

When the first rack 120 is withdrawn alone, the length of the multi-stage rack 110 increases.

After opening of the door 12 is finished, the first rack 120 and the second rack 140 are inserted into the door 12 and then the first rack 120 is moved alone to be inserted into the door 12 after insertion of the second rack 140 is finished.

When the first rack 120 is inserted alone, the length of the multi-stage rack 110 may decrease.

In some implementations, the first rack 120 pressurizes the cabinet 11. At this time, a rack cover 190 may be coupled to the front end of the first rack 120 to prevent the first rack 120 from directly contacting the cabinet 11.

The rack cover 190 may be formed of an elastic material such as rubber or silicon, for example. Accordingly, since the rack cover 190 is formed of an elastic material, it is possible to prevent the cabinet 11 from being deformed or an outer surface of the cabinet 11 from being scratched by force applied by the first rack 120.

The door opening part 101 may further include a plurality of transferring members 130 and 150 for moving the first rack 120 and the second rack 140 together.

The plurality of transferring members 130 and 150 connects the first rack 120 and the second rack 140 to withdraw the first rack 120 and the second rack 140 together after withdrawing the first rack 120 alone by the predetermined distance in the process of opening the door 12.

In contrast, the plurality of transferring members 130 and 150 may insert the first rack 120 and the second rack 140 together upon initial insertion of the multi-stage rack 110 after opening of the door 12 is finished.

The plurality of transferring members 130 and 150 may include a first transferring member 130 and a second transferring member 150.

The door opening part 101 may further a rack guide member 180 for guiding movement of the multi-stage rack 110.

The rack guide member 180 may guide sole withdrawal and sole insertion of the first rack 120. In some examples, the rack guide member 180 may move along with the second rack 140 upon withdrawing and inserting the second rack 140.

The door opening part 101 may further include a guide cover 160 for guiding movement of the second transferring member 150.

The first transferring member 130 may be fixed to the first rack 120 and the guide cover 160 may be fixed to the second rack 140, without being limited thereto.

The door opening device 100 may include a sensing unit for sensing the position of the multi-stage rack 110. For example, the sensing unit may include a magnet 158 and a plurality of Hall sensors for sensing magnetism of the magnet 158.

The magnet 158 may move along with the multi-stage rack 110 and the plurality of Hall sensors may be fixed to the support frames 300 and 310.

The magnet 158 may be provided in the second rack 140 or the guide cover 160, for example.

Hereinafter, the multi-stage rack 110 and the plurality of transferring members 130 and 150 will be described in greater detail.

Figure 5:
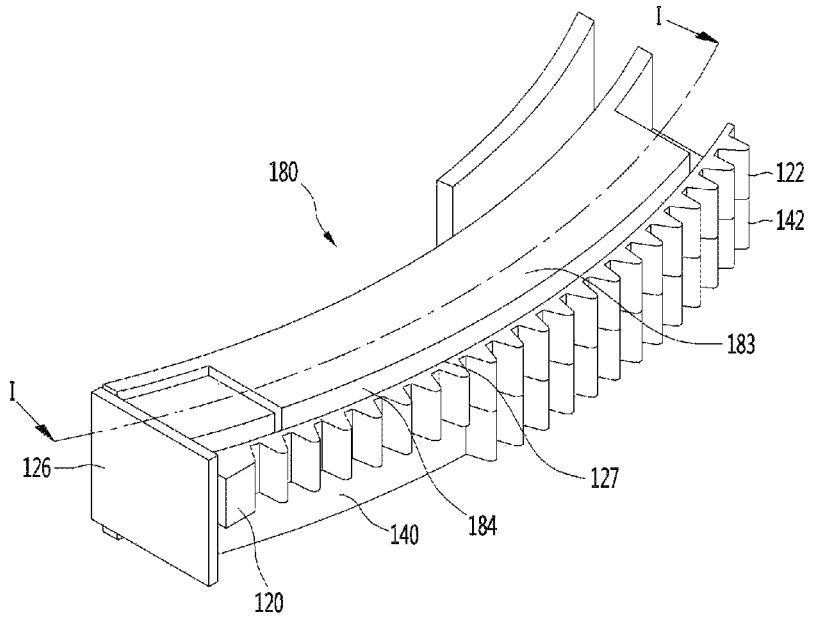
FIG. 5 is a perspective view showing an example multi-stage rack.
Figure 6:
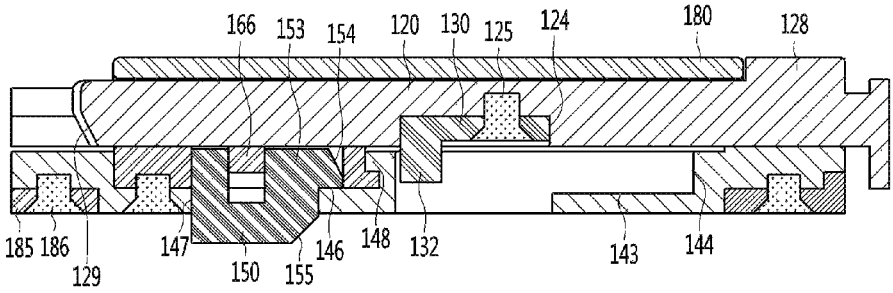
FIG. 6 is a cross-sectional view taken along line I-I of FIG. 5.
Figure 7:
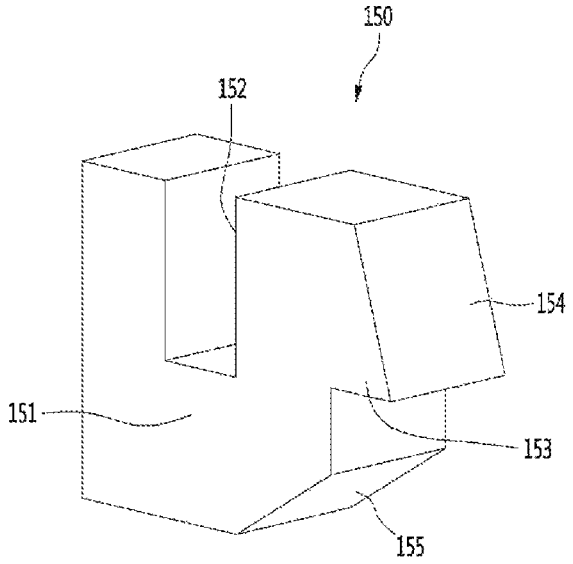
FIG. 7 is a perspective view showing an example second transferring member.
Figure 8:
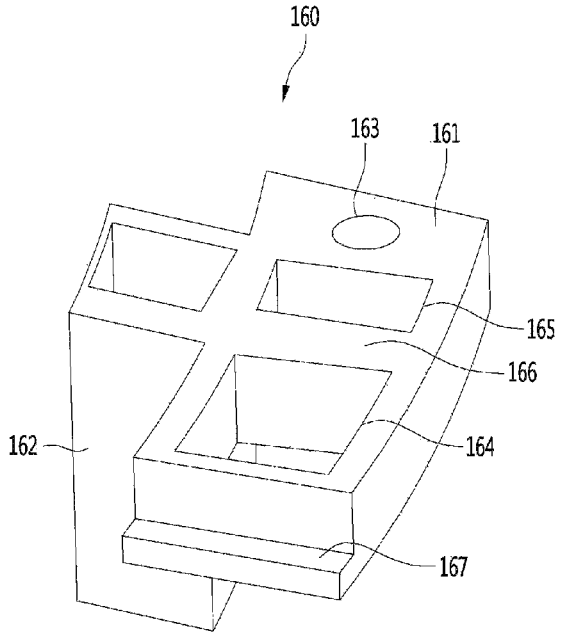
FIG. 8 is a perspective view showing an example guide cover.

FIG. 5 is a perspective view showing an example multi-stage rack, FIG. 6 is a cross-sectional view taken along line I-I of FIG. 5, FIG. 7 is a perspective view showing an example second transferring member, and FIG. 8 is a perspective view showing an example guide cover.

Referring to FIGS. 4 to 8, the first rack 120 may be provided above the second rack 140. That is, the lower surface of the first rack 120 may face the upper surface of the second rack 140.

The first rack 120 may include a first rack body 121. The first rack body 121 may be formed in a curved shape such that the opening angle of the door 12 increases. Accordingly, the first rack body 121 curvilinearly moves. For example, the first rack body 121 may be formed in a curved shape having a predetermined radius from the rotation center of the door 12.

A first rack gear 122 to be engaged with the connection gear 230 may be formed in the first rack body 121. The first rack gear 122 may be consecutively formed in the longitudinal direction of the first rack body 121. That is, the first rack gear 122 may be formed to connect both ends of the first rack body 121.

A coupling part 126 for coupling the rack cover 190 may be formed on the front end of the first rack body 121.

A receiving part 124 for receiving the first transferring member 130 may be provided in the first rack body 121. The receiving part 124 may be formed by depressing the lower surface of the first rack body 121 upward.

The first transferring member 130 may be fastened to the first rack body 121 by a fastening member 125 such as a screw in a state of being received in the receiving part 124.

The first transferring member 130 may include a protrusion 132 protruding from the first rack body 121 downward in a state of being received in the receiving part 124.

The protrusion 132 serves to connect the first rack 120 and the second rack 140 in a state in which the first rack 120 moves alone by the predetermined distance.

A guide groove 127, in which the guide ribs 183 and 184 of the rack guide member 180 are received, may be formed in the upper surface of the first rack body 121.

Since the first rack body 121 is curvilinearly moved, some of the guide ribs 183 and 184 and the guide groove 127 may be formed in a curved shape so as to prevent interference between the first rack body 121 and the guide ribs 183 and 184.

The second rack 140 may include a second rack body 141. The second rack body 141 may be formed in a curved shape to increase the opening angle of the door 12. Accordingly, the second rack body 141 is curvilinearly moved. For example, the second rack body 141 may be formed in a curved shape having a predetermined radius from the rotation center of the door 12.

A second rack gear 142 to be engaged with the connection gear 230 may be formed in the second rack body 141. The second rack gear 142 may be partially formed in the longitudinal direction of the second rack body 141.

More specifically, a part of the second rack body 141, which is first withdrawn from the door 12, may be referred to as a first end. An end opposite to the front end of the second rack body 141 may be referred to as a rear end.

The second rack gear 142 is not formed in a part of the second rack body 141 from the front end to a point spaced apart from the front end toward the rear end by a predetermined distance. The second rack gear 142 is formed in a part from the middle part of the second rack body 141 to the end of the second rack body 141.

In the present specification, a part of the second rack body 141, in which the second rack gear 142 is not provided, may be referred to as a front part and a part of the second rack body 141, in which the second rack gear 142 is provided, may be referred to as a rear part.

In some examples, the position of the multi-stage rack 110 inserted into the door 12 in a state in which the door 12 is closed may be referred to an initial position of the multi-stage rack 110. In some examples, the position of the multi-stage rack 110 completely withdrawn from the door in order to open the door 12 may be referred to as a door opening position of the multi-stage rack 110. The multi-stage rack 110 may be reciprocally moved between the initial position and the door opening position.

At this time, at the initial position of the multi-stage rack 110, the connection gear 230 is engaged with the first rack gear 122 and is not engaged with the second rack gear 142.

At this initial position of the multi-stage rack 110, the front part of the second rack body 141 faces the connection gear 230.

In some implementations, when the second rack gear 142 is not formed in the front part of the second rack body 141, the rotation power of the connection gear 230 is transferred to only the first rack 120 when the door 12 is initially opened.

Accordingly, only the first rack 120 may move alone in a state in which the second rack 140 is stopped.

A receiving groove 143, in which the protrusion 132 of the first transferring member 130 is received, may be provided in the upper surface of the second rack body 141. The receiving groove 143 may be formed in the longitudinal direction of the second rack body 141 by a predetermined length.

At this time, the horizontal length of the receiving groove 143 may be greater than that of the protrusion 132. The receiving groove 143 may be formed in a curved shape.

Due to a difference in length between the receiving groove 143 and the protrusion 132, the protrusion 132 may move in the receiving groove 143 in a state in which the protrusion 132 is received in the receiving groove 143.

The receiving groove 143 may include a transferring surface 144 which the protrusion 132 contacts in a process of moving the protrusion 132.

When the protrusion 132 contacts the transferring surface 144, movement of the first rack body 121 relative to the second rack body 141 is restricted.

When the protrusion 132 contacts the transferring surface 144, the first rack 120 and the second rack 140 are connected. In this state, when the rotation power of the connection gear 230 is transferred to the first rack 120, the first rack 120 moves to pull the second rack 140 and thus the second rack 140 also moves.

That is, in a state in which the protrusion 132 contacts the transferring surface 144, movement power of the first rack 120 may move to the transferring surface 144 through the protrusion 132 such that the second rack 140 moves along with the first rack 120.

A seating groove 146, in which the guide cover 160 is seated, may be provided in the second rack body 141. The seating groove 146 may be formed by depressing a portion of the upper surface of the second rack body 141 downward, for example.

In some examples, an opening 147, through which the second transferring member 150 penetrates, may be provided in the second rack body 141.

The opening 147 may be formed in the seating groove 146, for example. The second transferring member 150 may penetrate through the opening 147 from the upper side of the second rack body 141. In a state in which the second transferring member 150 penetrates through the opening 147, a portion of the second transferring member 150 may be seated in the seating groove 146.

The second transferring member 150 may include a transferring body 151. At the upper portion of the front end of the transferring body 151, a contact projection 153 which may contact the first rack body 121 in a process of opening the door 12 may be provided.

In some implementations, the contact projection 153 may be seated in the seating groove 146 in a state in which the second transferring member 150 penetrates through the opening 147. In a state in which the contact projection 153 is seated in the seating groove 146, the second transferring member 150 is spaced apart from the first rack 120.

In some examples, in a state in which the contact projection 153 is seated in the seating groove 146, downward movement of the second transferring member 150 is restricted.

The contact projection 153 may include a pressurization surface 154. The pressurization surface 154 may be outwardly inclined from the upper surface of the contact projection 153 toward the lower side thereof. That is, the horizontal length of the contact projection 153 increases toward the lower side thereof by the pressurization surface 154. Effects which may be obtained by the pressurization surface 154 will be described below.

An inclined surface 155 may be provided in the lower portion of the front end of the transferring body 151. The inclined surface 155 may be inwardly inclined toward the lower side thereof. That is, by the inclined surface 155, the horizontal length of the transferring body 151 decreases from the uppermost end of the inclined surface 155 of the transferring body 151 toward the lower side thereof.

The guide cover 160 may include a cover part 161 covering the second transferring member 150. In some examples, the guide cover 160 may further include a magnet receiving part 162 in which the magnet 158 is received.

The cover part 161 may be seated in the seating groove 146 of the second rack body 141. The cover part 161 may be fastened to the second rack body 141 by the fastening member 168 such as a screw in a state of being seated in the seating groove 146.

A fastening hole 163 for fastening of the fastening member 168 may be formed in the cover part 161.

A locking rib 148 is formed in the second rack body 141 in order to facilitate fastening of the fastening member 168 and a rib seating part 167, in which the locking rib 148 is seated, is provided in the cover part 161.

Accordingly, in a state in which the locking rib 148 is seated in the rib seating part 167 of the cover part 161, the cover part 161 is primarily fastened to the second rack body 141. In this state, the cover part 161 and the second rack body 141 are secondarily fastened by the fastening member 168.

The cover part 161 may guide vertical movement of the second transferring member 150 and restrict upward movement of the second transferring member 150 in a state in which the second transferring member 150 moves upward to a predetermined position.

For example, a plurality of holes 164 and 165, which at least two portions of the second transferring member 150 penetrate, may be provided in the cover part 161. The plurality of holes 164 and 165 may be spaced apart from each other in the insertion-and-withdrawal direction of the multi-stage rack 110, for example.

At this time, since the plurality of holes 164 and 165 is spaced apart from each other, the guide part 166 may be provided between the plurality of holes 164 and 165.

In a guide slot 152, into which the guide part 166 is inserted, may be formed in the transferring body 151. The guide slot 152 may be formed by depressing the upper surface of the transferring body 151 downward.

In a state in which the contact projection 153 of the second transferring member 150 is seated in the seating groove 146, the second transferring member 150 is located in the plurality of holes 164 and 165 and the guide part 166 is located in the guide slot 152.

In some cases, the vertical length (or height) of the guide slot 152 may be greater than that of the guide part 166, such that the second transferring member 150 moves upward in a state in which the guide part 166 is located in the guide slot 152.

In some examples, the guide part 166 may be located in the guide slot 152 at the upper side of the guide slot 152, in a state in which the contact projection 153 of the second transferring member 150 is seated in the seating groove 146.

The vertical length of the second transferring member 150 may be greater than that of the second rack body 141.

Accordingly, a portion of the second transferring member 150 protrudes downward from the second rack body 141 in a state in which the contact projection 153 of the second transferring member 150 is seated in the seating groove 146 of the second rack body 141.

In some examples, when the second transferring member 150 is elevated by the below-described frame guide 304, a portion of the second transferring member 150 may protrude upward from the second rack body 141.

The rack guide member 180 may include a guide body 181 having a curved shape. The guide body 181 contacts the side surface of the first rack body 121 to guide curvilinear movement of the first rack body 121.

Guide ribs 183 and 184 are formed on the upper side of the guide body 181. The guide ribs 183 and 184 may include a first rib 183 extending from the upper end of the guide body 181 in a horizontal direction.

The first rib 183 may cover a portion of the upper surface of the first rack body 121. Accordingly, the first rack body 121 may be prevented from moving upward in a process of inserting or withdrawing the first rack body 121.

The guide ribs 183 and 184 may further include the second rib 184 extending downward from the end of the first rib 183. The second rib 184 is inserted into the guide groove 127 of the first rack body 121.

By the second rib 184, it is possible to stabilize curvilinear movement of the first rack body 121 and to prevent the first rack body 121 from escaping from a curved movement path of the first rack body 121.

A stopping projection 128 may be provided on the front end of the upper surface of the first rack body 121. The stopping projection 128 may protrude upward from the upper surface of the first rack body 121. The stopping projection 128 contacts the first rib 183 of the rack guide member 180 when the first rack 120 is inserted. When the stopping projection 128 contacts the first rib 183, insertion of the first rack 120 is restricted.

That is, the stopping projection 128 serves to determine the insertion end position of the first rack 120 when the first rack 120 is inserted.

The rack guide member 180 may further include a support rib 185 extending from the lower surface of the guide body 181 in the horizontal direction.

The second rack body 141 may be seated in the upper surface of the support rib 185. The fastening member 186 fastens the second rack body 141 and the support rib 185 in a state in which the second rack body 141 is seated in the support rib 185.

Accordingly, the rack guide member 180 may move along with the second rack body 141.

A plurality of support ribs 185 may be provided to prevent relative movement of the rack guide member 180 and the second rack body 141.

For example, the plurality of support ribs 185 may be arranged to be spaced apart from each other in the longitudinal direction of the second rack body 141. The fastening member 186 may be fastened to each of the plurality of support ribs 185 in a state in which the second rack body 141 is seated in the plurality of support ribs 185.

A portion of the second rack body 141 may be located between the plurality of support ribs 185 in a state in which the second rack body 141 is seated in the plurality of support ribs 185. In some examples, the second transferring member 150 may be located between the plurality of support ribs 185.

In some implementations, referring to FIG. 6, the first rack body 121 and the second rack body 141 may be formed of metal in order to prevent damage thereof. Each of the rack bodies 121 and 141 may be formed of aluminum, without being limited thereto.

In this case, when the first rack body 121 and the second rack body 141 slide in a state of directly contacting each other, abrasion may be generated by friction between the first rack body 121 and the second rack body 141, thereby generating friction noise.

In some implementations, a member formed of a material different from that of the rack bodies 121 and 141 is provided between the first rack body 121 and the second rack body 141, in order to reduce abrasion and friction noise of the first rack body 121 and the second rack body 141.

For example, at least a portion of the guide cover 160 may be located between the first rack body 121 and the second rack body 141.

The guide cover 160 may be formed of a plastic material. For example, the guide cover 160 may be formed of polyoxymethylene (POM).

More specifically, the height of the upper surface of the guide cover 160 may be higher than that of the second rack body 141 in a state in which the guide cover 160 is fixed to the second rack body 141. That is, a portion of the guide cover 160 extends upward from the upper surface of the second rack body 141.

Accordingly, the lower surface of the first rack body 121 may be seated in the upper surface of the guide cover 160. When the lower surface of the first rack body 121 is seated in the upper surface of the guide cover 160, at least a portion of the lower surface of the first rack body 121 is spaced apart from the upper surface of the second rack body 141.

Accordingly, since the first rack body 121 slides along with the guide cover 160 in a process of inserting and withdrawing the first rack body 121, it is possible to prevent abrasion and friction noise of the first rack body 121 and the second rack body 141.

Alternatively, the rack bodies 121 and 141 may be formed of a super engineering plastic material such as polyether ether ketone (PEEK) or polyphenylene sulfide (PPS).

Even in this case, the lower surface of the first rack body 121 may be provided to slide along with the guide cover 160.

Figure 9:
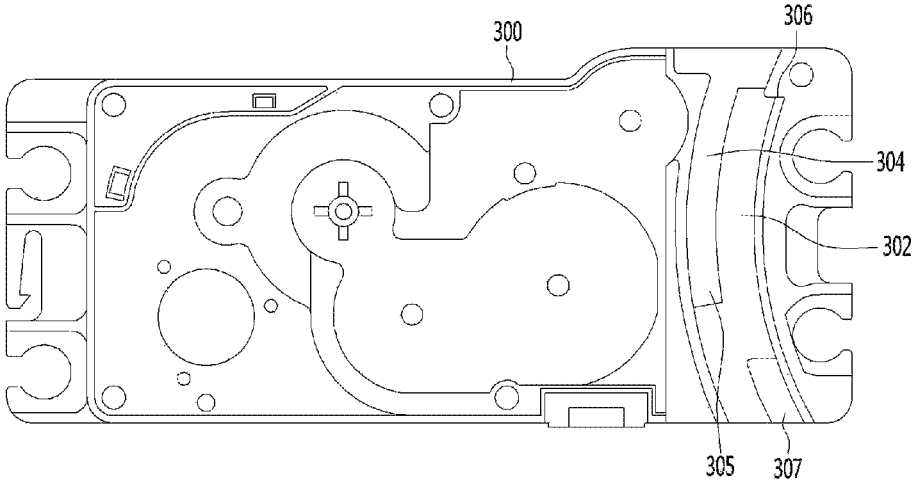
FIG. 9 is a plan view showing an example support frame.
Figure 10:
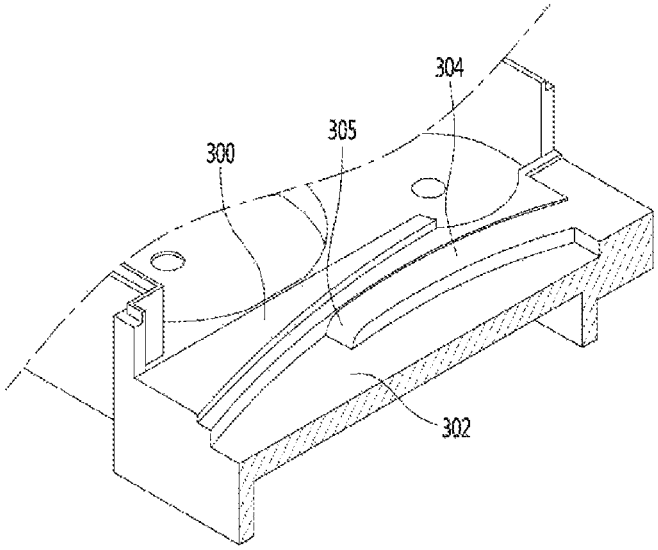
FIG. 10 is a view showing an example frame guide in the support frame of FIG. 9.

FIG. 9 is a plan view showing an example support frame, and FIG. 10 is a view showing a frame guide in the support frame of FIG. 9.

Referring to FIGS. 6, 9 and 10, the support frame 300 may include a rack receiving part 302 in which the multi-stage rack 110 is received. The rack receiving part 302 may be formed in a curved shape in correspondence with curvilinear movement of the multi-stage rack 110.

The rack receiving part 302 may be formed by depressing a portion of the upper surface of the support frame 300 downward in order to receive the multi-stage rack 110.

A frame guide 304 for elevating the second transferring member 150 in a process of opening the door 12 may be provided on the bottom of the rack receiving part 302.

The frame guide 304 may protrude upward from the bottom of the rack receiving part 302. An end of the frame guide 304 may include an inclined guide surface 305 to elevate the second transferring member 150.

In a state of closing the door 12 or at the initial position of the multi-stage rack 110, the guide surface 305 faces the inclined surface 155 of the second transferring member 150. At this time, the guide surface 305 of the frame guide 304 may be brought into contact with or spaced apart from the inclined surface 155 of the second transferring member 150.

In the state of closing the door 12 or at the initial position of the multi-stage rack 110, a portion of the second rack body 141 may be seated in the upper surface of the frame guide 304.

In a process of moving the second rack body 141 along with the first rack body 121, the second transferring member 150 is elevated while the inclined surface 155 of the second transferring member 150 slides along the guide surface 305.

In a state in which the second transferring member 150 is elevated, the contact projection 153 of the second transferring member 150 may contact the first rack body 121 at the rear side of the first rack body 121. For example, the pressurization surface 154 of the contact projection 153 may contact the rear surface of the first rack body 121. At this time, since the pressurization surface 154 is inclined, an inclined contact surface 129 contacting the pressurization surface 154 is provided in the first rack body 121, such that the contact area between the pressurization surface 154 and the first rack body 121 increases.

The rack receiving part 302 may further include a withdrawal stopper 306 for stopping the multi-stage rack 110 at the door opening position in the process of withdrawing the multi-stage rack 110 and an insertion stopper 307 for stopping the multi-stage rack 110 at the initial position in the process of inserting the multi-stage rack 110.

The rack guide member 180 may further include a guide stopper 182 contacting the withdrawal stopper 306 in the process of withdrawing the multi-stage rack 110. The guide stopper 182 may be located at the opposite side of the support rib 185 in the guide body 181.

The guide stopper 182 may be located at the rear side of the guide body 181 in the longitudinal direction of the guide body 181.

The guide stopper 182 may cover a portion of the guide cover 160. For example, the guide stopper 182 may cover the magnet receiving part 162 of the guide cover 160.

The magnet receiving part 162 may contact the insertion stopper 307 in the process of inserting the multi-stage rack 110. As another example, the guide stopper 182 may contact the insertion stopper 307 in the process of inserting the multi-stage rack 110.

Hereinafter, operation of the multi-stage rack 110 will be described.

First, the process of withdrawing the multi-stage rack 110 from the door 12 in order to open the door 12 will be described.

Figure 11:
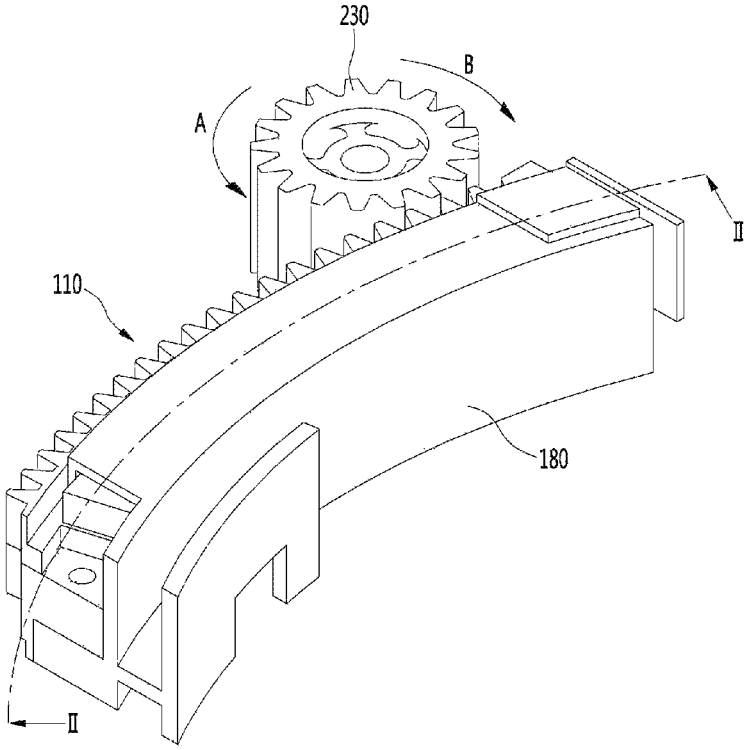
FIG. 11 is a view showing an example arrangement of an example multi-stage rack and an example connection gear located at an initial position of the multi-stage rack.

FIG. 11 is a view showing an example arrangement of an example multi-stage rack and an example connection gear at an initial position of the multi-stage rack.

Figure 12:
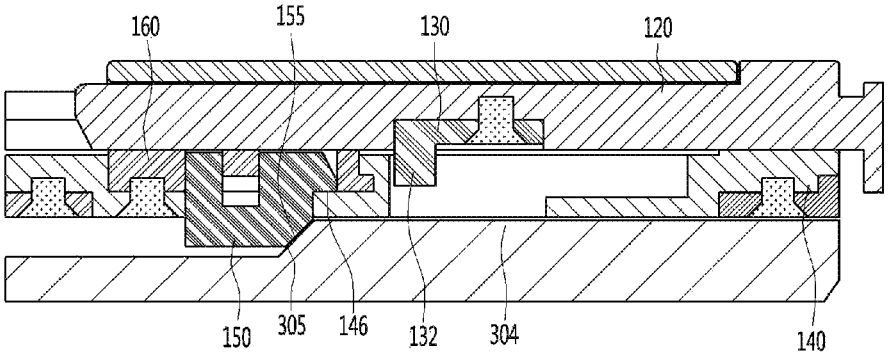
FIG. 12 is a cross-sectional view taken along line II-II of FIG. 11 showing the multi-stage rack located at the initial position.
Figure 13:
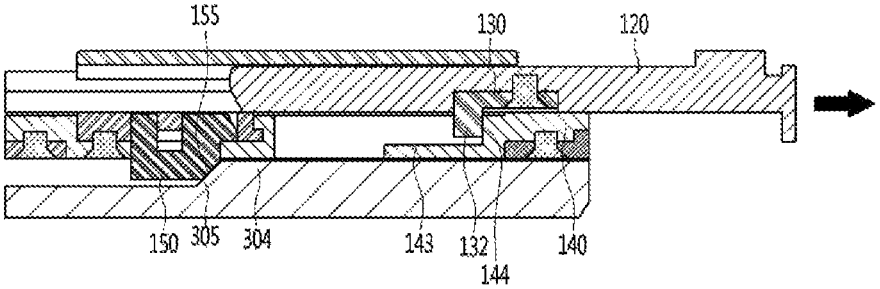
FIG. 13 is a cross-sectional view taken along line II-II of FIG. 11 showing the first rack withdrawn completely.
Figure 14:
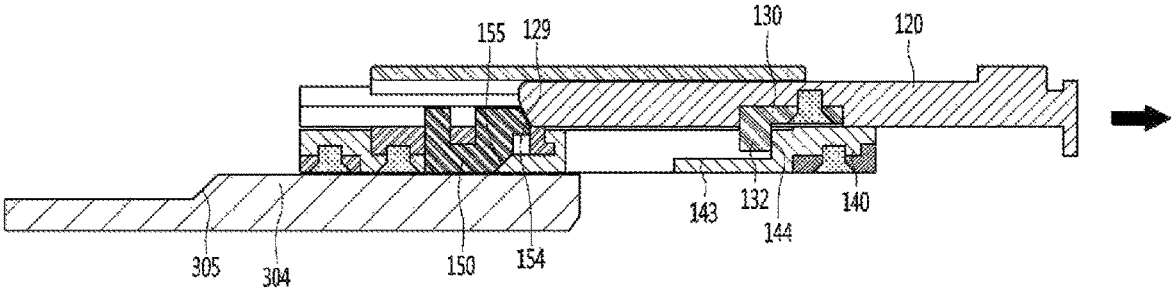
FIG. 14 is a cross-sectional view taken along line II-II of FIG. 11 showing the multi-stage rack withdrawn to a door opening position.

FIG. 12 is a cross-sectional view taken along line II-II of FIG. 11 showing the multi-stage rack located at the initial position, FIG. 13 is a cross-sectional view taken along line II-II of FIG. 11 showing a state in which the first rack is completely withdrawn, and FIG. 14 is a cross-sectional view taken along line II-II of FIG. 11 showing a state in which the multi-stage rack is withdrawn to a door opening position.

Referring to FIGS. 4 and 11 to 14, the driving unit 210 may rotate in a first direction in order to open the door 12. When the driving unit 210 rotates in the first direction, the connection gear 230 may rotate in a counter-clockwise direction (e.g., a direction denoted by arrow A) as shown in FIG. 11.

In the state shown in FIG. 11, the connection gear 230 is engaged with the first rack gear 122 of the first rack 120 but is not engaged with the second rack gear 142 of the second rack 140.

Accordingly, at the initial position of the multi-stage rack 110, the first rack 120 moves alone by rotation of the connection gear 230 in a state in which the second rack 140 is stopped. That is, only the first rack 120 is withdrawn from the door 12 by a predetermined distance.

For example, as shown in FIG. 13, the first rack 120 moves to the right in the figure.

In the process of withdrawing the first rack 120, the first transferring member 130 moves along with the first rack 120. Accordingly, the protrusion 132 of the first transferring member 130 moves within the receiving groove 143.

In some examples, the protrusion 132 of the first transferring member 130 moves in a direction which becomes close to the transferring surface 144, in a state of being spaced apart from the transferring surface 144 of the receiving groove 143.

When the first rack 120 is withdrawn by the predetermined distance, as shown in FIG. 13, the protrusion 132 of the first transferring member 130 contacts the transferring surface 144.

In a state in which the protrusion 132 of the first transferring member 130 contacts the transferring surface 144, movement power of the first rack 120 may be transferred to the second rack 140.

In some examples, in a state in which the protrusion 132 of the first transferring member 130 contacts the transferring surface 144, the connection gear 230 may be engaged with the first rack gear 122 but may not be engaged with the second rack gear 142.

As a period in which the first rack gear 122 and the second rack gear 142 are simultaneously engaged with the connection gear 230 increases, abrasion of the connection gear 230 and the rack gears 122 and 142 increases.

In some implementations, the connection gear 230 is not engaged with the second rack gear 142 in a state in which the protrusion 132 of the first transferring member 130 contacts the transferring surface 144, thereby reducing abrasion of the connection gear 230 and the second rack gear 142.

When the first rack 120 is continuously withdrawn in a state in which the protrusion 132 of the first transferring member 130 contacts the transferring surface 144, the second rack 140 is withdrawn along with the first rack 120. That is, the second rack 140 may move to the right side of FIG. 13.

In FIG. 13, in a state in which the first rack 120 is maximally withdrawn, the length L2 of a portion of the first rack 120 overlapping the second rack 140 in a vertical direction is greater than the length L1 of a portion of the first rack 120 not overlapping the second rack 140 in the vertical direction.

In the entire length of the first rack 120, as the length L1 of the portion of the first rack 120 not overlapping the second rack 140 in the vertical direction becomes greater than the length L2 of the portion of the first rack 120 overlapping the second rack 140 in the vertical direction, the maximum length of the multi-stage rack 110 may increase. In contrast, in the process of withdrawing the first rack 120 alone, if force is applied to the first rack 120 upward or downward in FIG. 13, the first rack 120 is bent upward or downward.

If the first rack 120 is bent, the first rack 120 may not be inserted into the door 12. In this case, the door 12 is not closed.

In some implementations, as compared to the case of using a single rack, the length L2 of the portion of the first rack 120 overlapping the second rack 140 in the vertical direction is greater than the length L1 of a portion of the first rack 120 not overlapping the second rack 140 in the vertical direction in a state in which the first rack 120 is maximally withdrawn, such that the first rack 120 is prevented from being bent while increasing the length of the rack.

In the process of moving the second rack 140 to the right side, the inclined surface 155 of the second transferring member 150 slides along the guide surface 305 of the frame guide 304.

Since the guide surface 305 is inclined upward in the withdrawal direction of the second rack 140, the second transferring member 150 is elevated by the guide surface 305 of the frame guide 304 in the process of withdrawing the second rack 140.

When the second transferring member 150 is elevated, the pressurization surface 154 of the second transferring member 150 contacts the contact surface 129 of the first rack body 121.

In a state in which the pressurization surface 154 of the second transferring member 150 contacts the contact surface 129 of the first rack body 121, the connection gear 230 may be engaged with the first rack gear 122 and the second rack gear 142 or the connection gear 230 may not be engaged with the first rack gear 122 but may be engaged with the second rack gear 142.

When the connection gear 230 is engaged with the first rack gear 122 and the second rack gear 142 at the position where the second transferring member 150 is elevated, rotation power of the connection gear 230 may be transferred to the first rack 120 and the second rack 140.

In this state, the first rack 120 and the second rack 140 may be withdrawn together. In the process of withdrawing the first rack 120 and the second rack 140 together, only the second rack gear 142 may be connected to the connection gear 230.

If only the second rack gear 142 is connected to the connection gear 230 when the first rack 120 and the second rack 140 are withdrawn together, the rotation power of the connection gear 230 is transferred to only the second rack 140.

In some implementations, since the pressurization surface 154 of the second transferring member 150 contacts the contact surface 129 of the first rack body 121 at the position where the second transferring member 150 is elevated, the second transferring member 150 may pressurize the first rack 120 to withdraw the first rack 120 in the process of withdrawing the second rack 140.

In some examples, even when the connection gear 230 is not engaged with the first rack gear 122 but is engaged with the second rack gear 142 at the position where the second transferring member 150 is elevated, the second transferring member 150 may pressurize the first rack 120 to withdraw the first rack 120 in the process of withdrawing the second rack 140.

When the second rack 140 is withdrawn at the position where the second transferring member 150 is elevated, the second transferring member 150 slides along the frame guide 304 in a state of being seated in the upper surface of the frame guide 304.

As shown in FIG. 14, when the multi-stage rack 110 moves to the door opening position, the driving unit 210 is stopped.

In some implementations, the length of the multi-stage rack is maximized in a state in which the multi-stage rack 110 moves to the door opening position, and the opening angle of the door 12 increases by increase in the length of the multi-stage rack.

In the process of withdrawing the multi-stage rack 110, the first rack 120 pressurizes the cabinet 11 to rotate the door 12, thereby opening the door 12.

Next, the process of inserting the multi-stage rack 110 into the door 12 in a state in which opening of the door is finished will be described.

Figure 15:
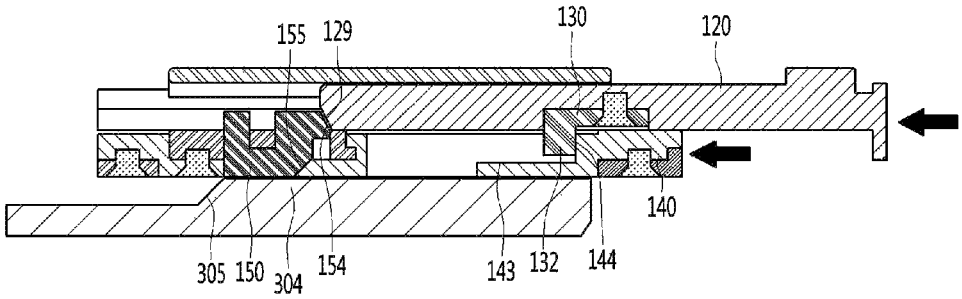
FIG. 15 is a cross-sectional view taken along line II-II of FIG. 11 showing the first rack being inserted.
Figure 16:
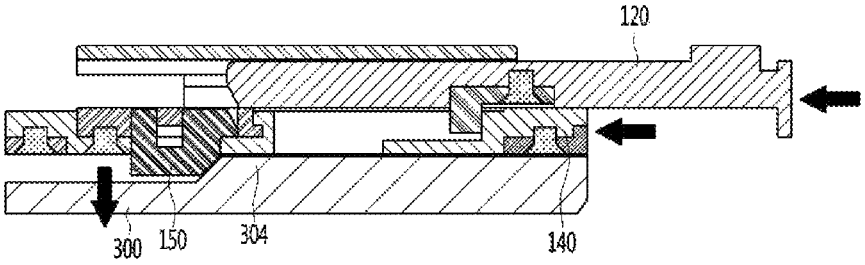
FIG. 16 is a cross-sectional view taken along line II-II of FIG. 11 showing an example secondary transferring member being moved down.
Figure 17:
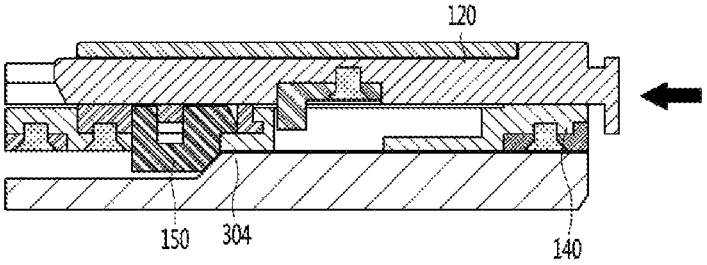
FIG. 17 is a cross-sectional view taken along line II-II of FIG. 11 showing the multi-stage rack moved to the initial position.

FIG. 15 is a cross-sectional view taken along line II-II of FIG. 11 showing a state in which the first rack is inserted, FIG. 16 is a cross-sectional view taken along line II-II of FIG. 11 showing a state in which the secondary transferring member is moved down, and FIG. 17 is a cross-sectional view taken along line II-II of FIG. 11 showing a state in which the multi-stage rack is moved to the initial position.

Referring to FIGS. 11 and 14 to 17, after withdrawal of the multi-stage rack 110 to the door opening position is finished, the driving unit 210 is stopped.

When a predetermined time has passed after the driving unit 210 is stopped, the driving unit 210 rotates in a second direction opposite the first direction.

When the driving unit 210 rotates in the second direction, the connection gear 230 may rotate in a clockwise direction (denoted by arrow B) of FIG. 11.

In a state in which the multi-stage rack 110 is withdrawn to the door opening position, the connection gear 230 is engaged with the second rack gear 142.

In some examples, in a state in which the multi-stage rack 110 is withdrawn to the door opening position, the transferring surface 144 of the second rack body 141 contacts the protrusion 132 of the first transferring member 130.

Accordingly, when the connection gear 230 rotates, the second rack 140 is inserted. In the process of inserting the second rack 140, the movement power of the second rack 140 is transferred to the protrusion 132 of the first transferring member 130 through the transferring surface 144 such that the first rack 120 is inserted along with the second rack 140.

In some examples, in the process of inserting the second rack 140, engagement between the connection gear 230 and the second rack gear 142 is released and the connection gear 230 is engaged with the first rack gear 122. In this state, the rotation power of the connection gear 230 is transferred to only the first rack 120.

Even when the rotation power of the connection gear 230 is transferred to only the first rack 120, since the contact surface 129 of the first rack 120 contacts the pressurization surface 154 of the second transferring member 150, the movement power of the first rack 120 is transferred to the second transferring member 150 through the contact surface 129 and the pressurization surface 154.

In some cases, in the process of inserting the first rack 120, the second rack 140 may be inserted therewith.

In the process of inserting the second rack 140, the second transferring member 150 slides along the upper surface of the frame guide 304.

When the second transferring member 150 escapes from the frame guide 304 when the rotation power of the connection gear 230 is transferred to only the first rack 120, the second transferring member 150 may move downward.

In this state, the second transferring member 150 may be moved down by the weight thereof and pressurization force applied to the first rack 120.

At this time, since the pressurization surface 154 of the second transferring member 150 is inclined, the second transferring member 150 may be stably moved down in a process of transferring the pressurization force of the first rack 120 to the second transferring member 150.

When the pressurization surface 154 of the second transferring member 150 is vertically provided and the second transferring member 150 is not moved down by the weight thereof or is incompletely moved down, the second transferring member 150 is not moved down even when the first rack 120 pressurizes the pressurization surface 154 of the second transferring member 150.

If the second transferring member 150 is not moved down, since the second transferring member 150 restricts insertion of the first rack 120, the first rack 120 is not completely inserted into the door 12 and thus the door is not closed.

In some implementation, since the pressurization surface 154 of the second transferring member 150 is inclined, when the first rack 120 pressurizes the pressurization surface 154 of the second transferring member 150, the second transferring member 150 is moved down to prevent a phenomenon wherein the door 12 is not closed.

The guide cover 160 may contact the insertion stopper 307 at a position where the second transferring member 150 is moved down and thus insertion of the second rack 140 may be finished.

After the second transferring member 150 is moved down, movement power of the first rack 120 is not transferred to the second rack 140. Accordingly, the first rack 120 may be inserted alone.

In a state in which the multi-stage rack 110 is inserted and moved to the initial position, the length of the multi-stage rack 110 is minimized. Accordingly, in a state in which the multi-stage rack 110 is inserted into the door 12, the multi-stage rack 110 may become compact.

Figure 18:
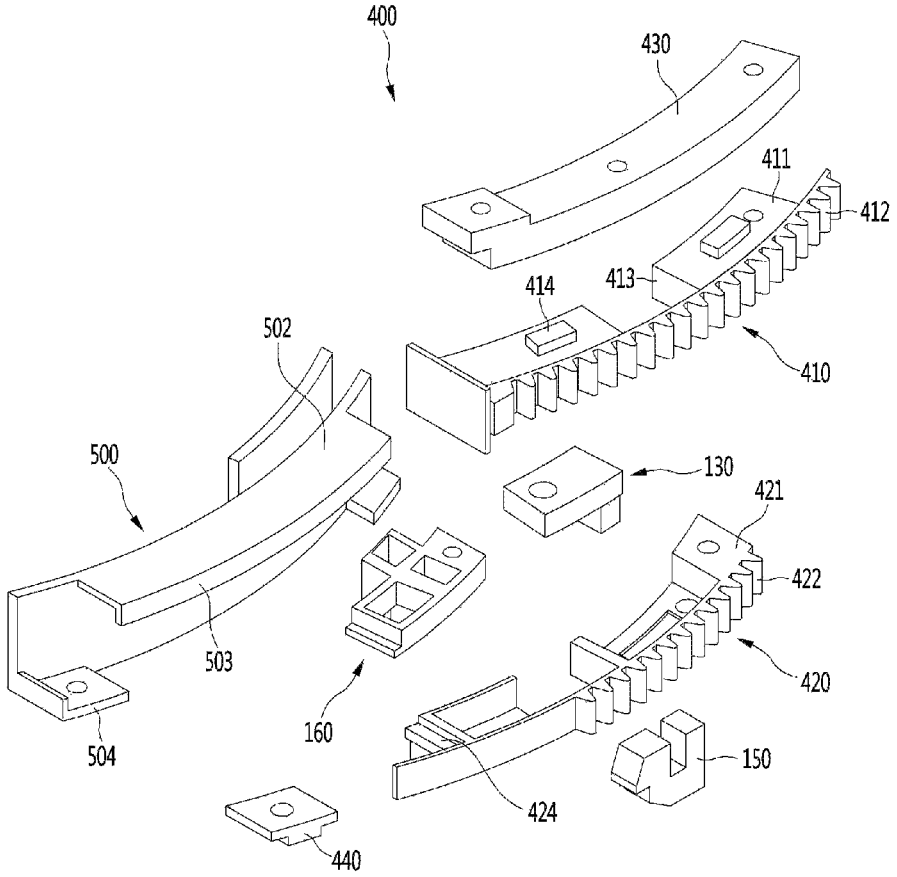
FIG. 18 is a perspective view showing another example door opening part.
Figure 19:
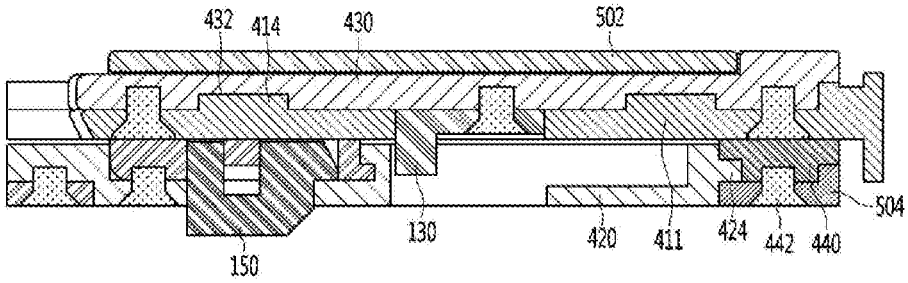
FIG. 19 is a cross-sectional view showing another example door opening part.

FIG. 18 is a perspective view showing another example door opening part, and FIG. 19 is a cross-sectional view showing another example door opening part.

This example is similar to the previous examples except for technology for preventing abrasion of the first rack and the second rack. Accordingly, hereinafter, only the features of the present example will be described.

Referring to FIGS. 18 and 19, the door opening part may include a multi-stage rack 400.

The multi-stage rack 400 may include a first rack 410 and a second rack 420. The functions and operation mechanisms of the first rack 410 and the second rack 420 are similar to the first rack 120 and the second rack 140 of the previous examples.

The door opening part may further include a rack guide member 500 for guiding movement of the multi-stage rack 400. The shape and function of the rack guide member 500 is similar to the rack guide member 180 of the previous examples.

The first rack 410 may include a first rack body 411 and a first rack gear 412.

The first rack body 411 may be coupled with a first friction member 430.

The first rack 410, the second rack 420 and the rack guide member 500 may be formed of metal, for example. The first and second racks 410 and 420 may be formed of aluminum, without being limited thereto.

The first friction member 430 prevents direct friction between the rack guide member 180 and the first rack 410. For example, the first friction member 430 may be located between one surface of the rack guide member 500 and the first rack 410.

The first friction member 430 may be formed of a plastic material. For example, the first friction member 430 may be formed of polyoxymethylene (POM).

The rack guide member 500 may include guide ribs 502 and 503. The guide ribs 502 and 503 may include a first rib 502 extending in a horizontal direction and a second rib 503 extending from an end of the first rib 502 downward.

The first friction member 430 may be fastened to the upper surface of the first rack body 411. Accordingly, the first friction member 430 may contact the guide ribs 502 and 503. The first friction member 430 may contact one or more of the first rib 502 and the second rib 503.

In some implementations, direct friction between the first rack 410 and the rack guide member 500 may be prevented to prevent abrasion and friction noise of the first rack 410 and the rack guide member 500.

The first friction member 430 may be fastened to the first rack body 411 by a fastening member 436 such as a screw, for example. A fastening projection 414 may be provided on any one of the first friction member 430 and the first rack body 411 and a fastening groove 432 in which the fastening projection 414 is received may be provided in the other of the first friction member 430 and the first rack body 411, such that the fastening position of the fastening member 436 is guided. FIG. 19 shows the fastening projection 414 provided on the first rack body 411, for example.

In order to secure a space in which the second rib 503 is located in a state in which the first friction member 430 is fastened to the first rack body 411, the first friction member 430 is spaced apart from the first rack gear 412.

More specifically, the vertical length of the first rack body 411 is less than that of the first rack gear 412. The upper surface of the first rack body 411 is lower than the upper surface of the first rack gear 412.

Accordingly, when the first friction member 430 is fastened to the upper surface of the first rack body 411 at a position horizontally spaced apart from the first rack gear 412, a rib receiving space is formed between the first friction member 430 and the first rack gear 412.

In some examples, the second rib 503 of the guide ribs 502 and 503 may be received in the rib receiving space.

A receiving groove 413, in which the first transferring member 130 is received, is formed in the first rack body 411. The receiving groove 413 may be a slot formed in the first rack body 411.

In a state in which the first friction member 430 is fastened to the first rack 410, the first transferring member 130 may be received in the receiving groove 413 from the lower side of the first rack 410. In a state in which the first transferring member 130 is received in the receiving groove 413, the first transferring member 130 may contact the lower surface of the first friction member 430. The first transferring member 130 may be fastened to the first friction member 430. Alternatively, the first transferring member 130 may be fastened to the first rack 410 in a state of being received in the receiving groove 413.

The second rack 420 may include a second rack body 421 and a second rack gear 422. The second rack body 421 may be seated in the rack guide member 500.

For example, the rack guide member 500 may include a support rib 504 supporting the second rack body 421. The rack guide member 500 may include a plurality of support ribs 504 in order to stably support the second rack body 421.

A second friction member 440 may be seated in the second rack 420. The second friction member 440 prevents direct friction between the first rack 410 and the second rack 420.

The second friction member 440 may be formed of the same material as the first friction member 430.

The second friction member 440 may be seated in the second rack 420 and one support rib 504 in a state in which the second rack 420 is seated in the plurality of support ribs 504, for example.

For example, the second rack 420 may include a support projection 424 supporting the second friction member 440.

In a state in which the second friction member 440 is seated in the support projection 424, the second friction member 440 may be fastened to one support rib 504 by the fastening member 442.

In a state in which the second friction member 440 is seated in the support projection 424, the height of the upper surface of the second friction member 440 is greater than that the upper surface of the second rack 420. Accordingly, friction occurs between the upper surface of the second friction member 440 and the lower surface of the first rack 410.

In this example, the door opening part may further include a guide cover 160 and a second transferring member 150 having the same functions as the previous examples.

The guide cover 160 may be fastened to the second rack 420. In a state in which the guide cover 160 is fastened to the second rack 420, the height of the upper surface of the guide cover 160 may be higher than that of the upper surface of the second rack 420.

Accordingly, friction occurs between the upper surface of the guide cover 160 and the lower surface of the first rack 410.

In some implementations, the guide cover 160 may be formed of the same material as the friction members 430 and 440. Accordingly, the guide cover 160 may serve as a third friction member.

Since the operation mechanism of the multi-stage rack 400 is similar to that of the multi-stage rack of the previous examples, a detailed description thereof will be omitted.

Although the racks 410 and 420 may be formed of metal in the above-described examples, the racks 410 and 420 may be formed of a super engineering plastic material such as polyether ether ketone (PEEK) or polyphenylene sulfide (PPS).

Although the door opening device is provided in the door to push the cabinet in the above-described examples, the door opening device may be provided in the cabinet to push the door, thereby opening the door.

What is claimed is:

1. A refrigerator comprising:

a cabinet defining a storage compartment;

a door configured to open and close the storage compartment; and a door opening device configured to open the door, the door opening device including a driving unit and a pushing member configured to be pushed out by the driving unit to thereby open the door, wherein the pushing member includes:

a first rack configured to be driven by the driving unit in a first direction, and a second rack configured to be driven by the driving unit in the first direction, the first rack being slidably coupled to the second rack to thereby move relative to the second rack, and wherein each of the first and second racks is curved with a predetermined radius about a rotation center of the door.

2. The refrigerator of claim 1, wherein the first rack is configured to be withdrawn by a predetermined distance relative to the second rack, and wherein the first rack is configured to move together with the second rack based on the first rack being withdrawn by the predetermined distance relative to the second rack.

3. The refrigerator of claim 2, wherein the pushing member is configured, based on completion of opening the door, to return to an initial position, wherein the first rack is configured to move together with the second rack toward the initial position in a second direction opposite the first direction, and wherein the first rack is configured to move relative to the second rack to the initial position in the second direction.

4. The refrigerator of claim 1, wherein the first rack is configured to be withdrawn by a predetermined distance relative to the second rack, and wherein the door opening device further includes a first transferring member that is configured to couple the first rack to the second rack and to transfer movement power from the first rack to the second rack based on the first rack being withdrawn by the predetermined distance.

5. The refrigerator of claim 4, wherein the first transferring member includes a protrusion that is fixed to the first rack and that protrudes from the first rack toward the second rack, wherein the second rack defines a receiving groove configured to receive the protrusion of the first transferring member, and wherein the receiving groove extends along the second rack by a predetermined length greater than a length of the protrusion along the first rack.

6. The refrigerator of claim 4, further comprising a second transferring member that is movably provided in the second rack and that is configured to transfer movement power from the second rack to the first rack based on the second rack moving in the first direction.

7. The refrigerator of claim 6, wherein the door opening device further includes a power transmission part that includes a connection gear configured to transfer power of the driving unit to the pushing member, wherein the first rack includes a first rack gear configured to engage with the connection gear, and wherein the second rack includes a second rack gear configured to engage with the connection gear.

8. The refrigerator of claim 7, wherein the first rack gear is arranged along a longitudinal direction of the first rack, wherein the second rack gear is arranged at a rear portion of the second rack along a longitudinal direction of the second rack, and wherein the second transferring member is configured, based on the connection gear being engaged with the second rack gear, to contact the first rack to thereby transfer movement power of the second rack to the first rack.

9. The refrigerator of claim 6, wherein the first rack is located vertically above the second rack, and wherein the second transferring member is movably provided in the second rack and configured to move in a vertical direction.

10. The refrigerator of claim 9, further comprising a support frame defining a receiving space that receives the pushing member, wherein the support frame includes a frame guide located in the receiving space, the frame guide having:

a first portion extending in a horizontal direction, an inclined guide surface that slopes from the first portion and is configured to lift the second transferring member, and a second portion that extends from the inclined guide surface in the horizontal direction and is located vertically above the first portion, and wherein the second transferring member is configured to slide downward along the inclined guide surface toward the first portion of the frame guide based on the second rack being driven in a second direction opposite the first direction.

11. The refrigerator of claim 10, wherein the second transferring member includes an inclined surface configured to contact the inclined guide surface, and wherein the second transferring member is configured to be lifted to the second portion of the frame guide based on the inclined surface sliding upward along the inclined guide surface.

12. The refrigerator of claim 10, wherein the second transferring member includes a pressurization surface configured to contact the first rack based on the second transferring member being lifted by the inclined guide surface.

13. The refrigerator of claim 12, wherein the pressurization surface is inclined with respect to a top surface of the second transferring member, and wherein the second transferring member is configured to be lowered by movement power of the first rack based on the first rack pushing the pressurization surface.

14. The refrigerator of claim 13, wherein the first rack includes an inclined contact surface configured to contact the pressurization surface.

15. The refrigerator of claim 9, further comprising a guide cover fixed to the second rack and configured to guide vertical movement of the second transferring member.

16. The refrigerator of claim 15, wherein the guide cover is configured to contact the first rack based on the first rack moving over the second transferring member.

17. The refrigerator of claim 1, further comprising a rack guide member coupled to the second rack and configured to guide movement of the pushing member, wherein the rack guide member is configured to guide movement of the first rack based on the first rack moving relative to the second rack, and wherein the rack guide member is configured to move together with the second rack based on the second rack moving together with the first rack.

18. The refrigerator of claim 17, wherein the rack guide member includes a guide rib, and wherein the first rack includes a guide groove that receives the guide rib.

19. A refrigerator comprising:

a cabinet defining a storage compartment;

a door configured to open and close the storage compartment; and a door opening device configured to open the door, the door opening device including a driving unit and a pushing member configured to be pushed out by the driving unit to thereby open the door, wherein the pushing member includes:

a first rack configured to be driven by the driving unit in a first direction, a second rack slidably coupled to the second rack to thereby move relative to the first rack, and a friction member located between the first rack and the second rack to thereby prevent direct contact between the first rack and the second rack, the friction member being made of a different material than the first rack and the second rack.

20. A refrigerator comprising:

a cabinet defining a storage compartment;

a door configured to open and close the storage compartment; and a door opening device configured to open the door, the door opening device including a driving unit and a pushing member configured to be pushed out by the driving unit to thereby open the door, wherein the pushing member includes:

a first rack configured to be driven by the driving unit in a first direction, and a second rack slidably coupled to the second rack to thereby move relative to the first rack, and wherein, based on the first rack moving together with the second rack in the first direction, a length of a first portion of the first rack that overlaps with the second rack is greater than a length of a second portion of the first rack that protrudes from the second rack in the first direction.

* * * * *